US011927095B2

(12) United States Patent
Hagar et al.

(10) Patent No.: US 11,927,095 B2
(45) Date of Patent: Mar. 12, 2024

(54) STEERING PAD APPARATUS AND RELATED METHODS

(71) Applicant: Halliburton Energy Services, Inc., Nisku (CA)

(72) Inventors: Everett Philip Hagar, Devon (CA); Brian Lee Doud, Klein, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 494 days.

(21) Appl. No.: 17/283,183

(22) PCT Filed: Oct. 8, 2019

(86) PCT No.: PCT/CA2019/051435
§ 371 (c)(1),
(2) Date: Apr. 6, 2021

(87) PCT Pub. No.: WO2020/113311
PCT Pub. Date: Jun. 11, 2020

(65) Prior Publication Data

US 2021/0340820 A1 Nov. 4, 2021

Related U.S. Application Data

(60) Provisional application No. 62/775,509, filed on Dec. 5, 2018.

(51) Int. Cl.

| | |
|---|---|
| ***E21B 7/06*** | (2006.01) |
| ***E21B 17/10*** | (2006.01) |
| ***E21B 31/14*** | (2006.01) |

(52) U.S. Cl.
CPC ..... *E21B 7/06* (2013.01); *E21B 17/1014* (2013.01); *E21B 17/1085* (2013.01); *E21B 31/14* (2013.01)

(58) Field of Classification Search
CPC .... E21B 7/06; E21B 17/1014; E21B 17/1085; E21B 31/14
See application file for complete search history.

(56) References Cited

U.S. PATENT DOCUMENTS

| | | | |
|---|---|---|---|
| 4,416,339 | A | 11/1983 | Baker et al. |
| 5,941,323 | A | 8/1999 | Warren |

(Continued)

FOREIGN PATENT DOCUMENTS

| | | | |
|---|---|---|---|
| WO | WO2019/133034 | A1 | 7/2019 |
| WO | WO2019/133036 | A1 | 7/2019 |

*Primary Examiner* — Tara Schimpf
*Assistant Examiner* — Neel Girish Patel
(74) *Attorney, Agent, or Firm* — PARLEE MCLAWS LLP; Patrick Laycock; Craig Roddy

(57) ABSTRACT

A steering pad apparatus for a rotary steerable system is provided. The steering pad apparatus comprises a base comprising one or more base lugs, each of the base lugs defining a respective axial hole therein. The apparatus further comprises a steering pad hingedly coupled to the base, the steering pad comprising one or more pad lugs, each said pad lug defining a respective axial hole therein. The one or more pad lugs are coupled to the one or more base lugs such that each of the one or more pad lugs is adjacent to at least one of the one or more base lugs. The apparatus further comprises, for each adjacent base lug and pad lug, a respective one or more bushings received in at least one of: the hole of the pad lug; and the hole of the base lug.

19 Claims, 10 Drawing Sheets

(56) References Cited

U.S. PATENT DOCUMENTS

| | | | | |
|---|---|---|---|---|
| 5,971,085 | A * | 10/1999 | Colebrook | E21B 7/06 175/266 |
| 2006/0113111 | A1* | 6/2006 | Martinez | E21B 47/024 175/45 |
| 2006/0157283 | A1* | 7/2006 | Hart | E21B 17/1014 175/76 |
| 2010/0025116 | A1 | 2/2010 | Hutton | |
| 2019/0128071 | A1* | 5/2019 | Conger | E21B 34/06 |
| 2020/0318436 | A1* | 10/2020 | Doud | E21B 21/103 |

* cited by examiner

Section A-A

Enlarged View - B

STEERING PAD APPARATUS AND RELATED METHODS

RELATED APPLICATION

This application is a U.S. national stage patent application of International Patent Application No. PCT/CA2019/051435, filed on Oct. 8, 2019, which claims priority to U.S. Provisional Patent Application No. 62/775,509, filed on Dec. 5, 2018.

FIELD OF THE DISCLOSURE

This disclosure relates to rotary steerable systems. More particularly, the disclosure relates to rotary steerable systems for bottom hole assemblies in drilling applications.

BACKGROUND

A bottom hole assembly may comprise a steerable system. The steerable system may comprise components that move relative to a collar such as a steering head collar or drill collar. Such moving components may have surfaces that contact non-moving components of the steerable system. The contacting surfaces may wear over time. Wear of the contacting surfaces may eventually result in one or more components becoming loose or even failing. One existing method to reduce or slow wear of contacting surfaces is coating the surfaces with High Velocity Oxygen Fuel (HVOF).

HVOF coatings may have a number of undesirable characteristics. HVOF coatings may be difficult to manufacture and/or apply to the surfaces. The ideal spray angle of the HVOF relative to the surface being coated is 90 degrees. However, due to the geometry of some components (e.g. closely spaced lugs), the available spray angle may be significantly less than 90 degrees when applying the HVOF coating, which may result in an uneven and/or insufficiently smooth coating, and/or poor adhesion to the substrate. An uneven or insufficiently smooth coating may require grinding of the coating, which may require special fixtures in order to achieve tight tolerances. Poor adhesion can result in delamination and loss of the coating. Additionally, an HVOF coating may be brittle and/or susceptible to chipping and delamination from external contact. The coating may, therefore, be easily damaged by impact. Over time, an HVOF coating may wear away, and reapplication of the coating may be arduous or impractical.

BRIEF DESCRIPTION OF THE DRAWINGS

The present disclosure will be better understood having regard to the drawings in which.

DETAILED DESCRIPTION

Figure 1:
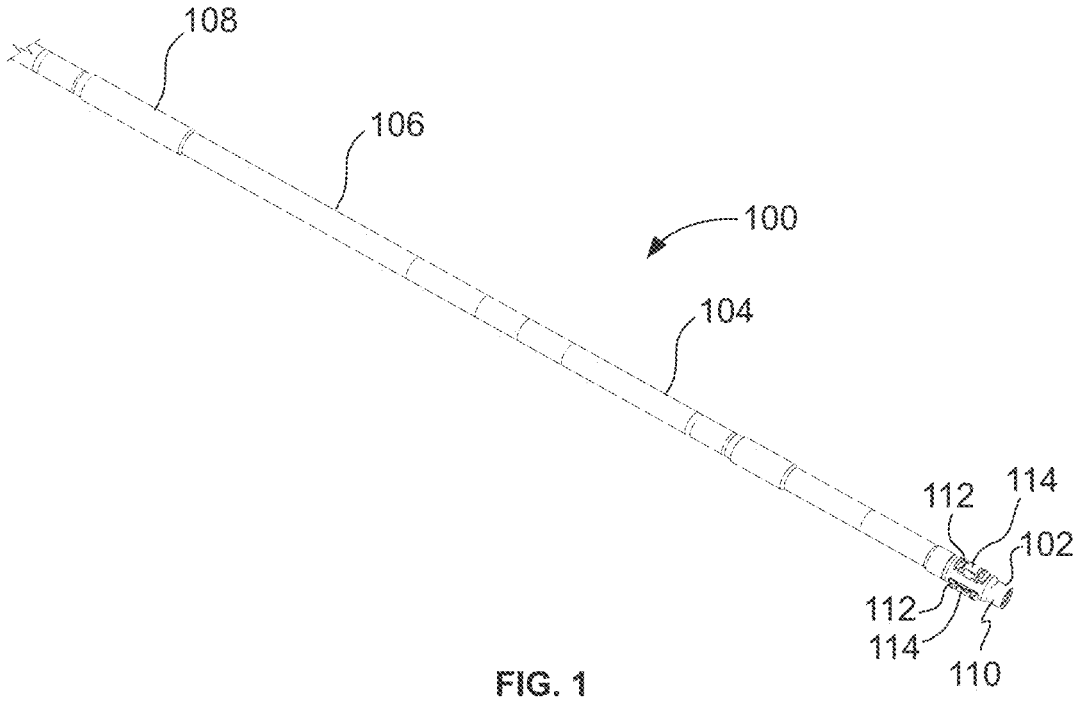
FIG. 1 is a perspective view of an example bottom hole assembly according to some embodiments.

A rotary steerable system may comprise a plurality of steering pad apparatuses, each comprising a steering pad rotatably coupled to a base by a hinge connection. The term "steering pad" may refer to any pad structure that may be extended against a formation wall (e.g. borehole wall) to provide a biasing force. The biasing force provided by the steering pads may be used for downhole steering. For example, a bottom hole assembly may comprise a plurality of steering pad apparatuses to steer a drill bit drilling a borehole.

The base may be any structure to which the steering pad is mountable. The base may, for example, be a pad housing that is mountable to a collar, such as a steering head collar or drill collar. The hinge connection may comprise lugs of the steering pad that are coupled to lugs of the base by one or more hinge pins. Contacting surfaces of the lugs may wear over time due to rotation of the pad relative to the base. For example, the presence of drilling mud in a drilling application and high RPM of the steering pads may lead to abrasive wear. If the wear becomes significant, the pads may become loose and/or critical internal components may begin to have interference of metal to metal contact. Such conditions may even lead to system failure.

Given the cost of steering pads and housings, it is preferable to be able to repair parts that have become damaged or worn down hole versus scrapping the entire part. HVOF coatings may be applied to the sides of the lugs to prevent or reduce such wear. However, such coatings may be difficult to apply and may degrade over time. For example, due to the spacing of lugs, the available spray angle may be much less than the optimal 90 degrees (e.g. 35 degrees) resulting in an uneven coating that requires subsequent grinding. Furthermore, repairing damaged or worn HVOF coatings may require collecting and shipping the steering pads to a manufacturer for stripping, reapplying, and grinding the HVOF coatings. Thus, maintaining HVOF coatings on steering pads may be difficult and/or expensive.

In one aspect, the disclosure provides a steering pad apparatus for a rotary steerable system. The steering pad apparatus may comprise a base comprising one or more base lugs, each of the base lugs defining a respective axial hole therein. The steering pad apparatus may further comprise a steering pad hingedly coupled to the base, the steering pad comprising one or more pad lugs. Each of the pad lugs may define a respective axial hole therein. The one or more pad lugs may be coupled to the one or more base lugs such that each of the one or more pad lugs is adjacent to at least one of the one or more base lugs. The steering pad apparatus may further comprise, for each adjacent base lug and pad lug, a respective one or more bushings received in at least one of: the hole of the pad lug; and the hole of the base lug.

In a non-limiting example, the steering pad apparatus further comprises at least one coupling member received through the one or more bushings and the holes of the one or more base lugs and the one or more pad lugs.

In another non-limiting example, for each said adjacent base lug and pad lug, the respective one or more bushings comprise first and second bushings.

In another non-limiting example, for each said adjacent base lug and pad lug, the respective first bushing is received in the hole of the pad lug at a side of the pad lug adjacent to the base lug; and the respective second bushing is received in the hole of the base lug at a side of the base lug adjacent to the pad lug.

In another non-limiting example, for each said adjacent base lug and pad lug, the respective one or more bushings maintain a separation between the pad lug and the base lug.

In another non-limiting example, for each said adjacent base lug and pad lug, each of the one or more bushings protrudes from a corresponding one of: a side of the pad lug adjacent to the base lug; and a side of the base lug adjacent to the pad lug.

In another non-limiting example, each said bushing comprises: a respective radial bearing portion and a respective thrust bearing portion.

In another non-limiting example, the one or more bushings comprise one or more flange bushings.

In another non-limiting example, each flange bushing comprises: a tubular cylindrical portion having first and second ends; and a respective flange portion about a periphery of the first end of the tubular cylindrical portion.

In another non-limiting example, for each said bushing, the corresponding lug comprises a respective groove about a periphery of the hole of the lug at a side of the lug through which the bushing is received, the groove being shaped to substantially receive the flange portion of the bushing.

In another non-limiting example, the flange portion is proud of the side of the lug.

In another non-limiting example, for each said bushing, the respective flange portion and the respective tubular cylindrical portion are a unitary structure.

In another non-limiting example, each of the one or more bushings is removable and replaceable.

In another non-limiting example, the one or more base lugs comprise a plurality of base lugs, and each of the one or more pad lugs is positioned between, and adjacent to, two of the plurality of base lugs.

In another non-limiting example, the base comprises a pad housing.

In another aspect, the disclosure provides a rotary steerable system for a downhole tool. The rotary steerable system may comprise a tool collar; and one or more steering pad apparatuses mounted on the collar. Each of the one or more steering apparatuses may comprise a respective base comprising one or more base lugs, each of the base lugs defining a respective axial hole therein. Each of the plurality of steering apparatuses may further comprise a respective steering pad hingedly coupled to the base comprising one or more pad lugs. Each of the pad lugs may define a respective axial hole therein. The one or more pad lugs may be coupled to the one or more base lugs such that each of the one or more pad lugs is adjacent to at least one of the one or more base lugs. The steering pad apparatus may further comprise, for each adjacent base lug and pad lug, a respective one or more bushings received in at least one of: the hole of the pad lug; and the hole of the base lug.

In another aspect, the disclosure provides a method for a steering pad apparatus comprising a steering pad and a base. The method comprises inserting one or more bushings into at least one of: one or more lugs of the base; and one or more lugs of the steering pad. The method may further comprise coupling the lugs of the steering pad to the lugs of the base to form a hinge connection between the base and the steering pad.

In another non-limiting example, coupling the lugs of the steering pad to the lugs of the base comprises coupling the lugs of the steering pad to the lugs of the base with one or more hinge pins, the one or more hinge pins being received in the one or more bushings.

Other aspects and features of the present disclosure will become apparent to those ordinarily skilled in the art upon review of the following description of some specific embodiments of the disclosure.

The term "coupled to" as used herein does not necessarily require a direct physical connection between two "coupled" elements. Unless expressly stated otherwise, these terms are to be understood as including indirect couplings between the two elements, possibly with one or more intermediate coupling elements.

FIGS. 1 to 12 described below are exemplary only. The steering pad apparatuses and the related methods described herein are not limited to the particular embodiments shown in the drawings. Furthermore, the steering pad apparatuses are not limited to use in a particular downhole application or system.

FIG. 1 is a perspective view of an example bottom hole assembly 100. The bottom hole assembly 100 may, for example, be positioned at the bottom of a drill string of a drilling rig. Some components of the example bottom hole assembly 100 include, but are not limited to: a steering head 102, drill collars 104 and 106 positioned uphole of the steering head 102, and a stabilizer 108 positioned uphole of the drill collars 104 and 106. The downhole assembly 100 may further comprise a drill bit (not shown) positioned downhole of the steering head 102 at a terminal end of the drill string. The example steering head 102 of this embodiment includes a steering head collar 110 and plurality of steering pad apparatuses 112 mounted thereon. The steering pad apparatuses 112 are spaced circumferentially about the steering head collar 110. In this example, three steering pad apparatuses 112 are included on the steering head 102, although more or fewer steering pad apparatuses may be included in other embodiments. The steering pad apparatuses 112 each include an extendable and retractable steering pad 114. The steering pad apparatuses 112 steer the bottom hole assembly 100 by extending the steering pads 114 against the formation (not shown).

The bottom hole assembly 100 in FIG. 1 is shown for illustrative purposes, and embodiments are not limited to the particular bottom hole assembly 100 or steering head 102 shown in FIG. 1. Furthermore, the steering pad apparatuses 112 are not limited to being mounted on the steering head 102. In some embodiments, for example, one or more steering pad apparatuses may be mounted on a drill collar or other component of the bottom hole assembly.

Figure 2:
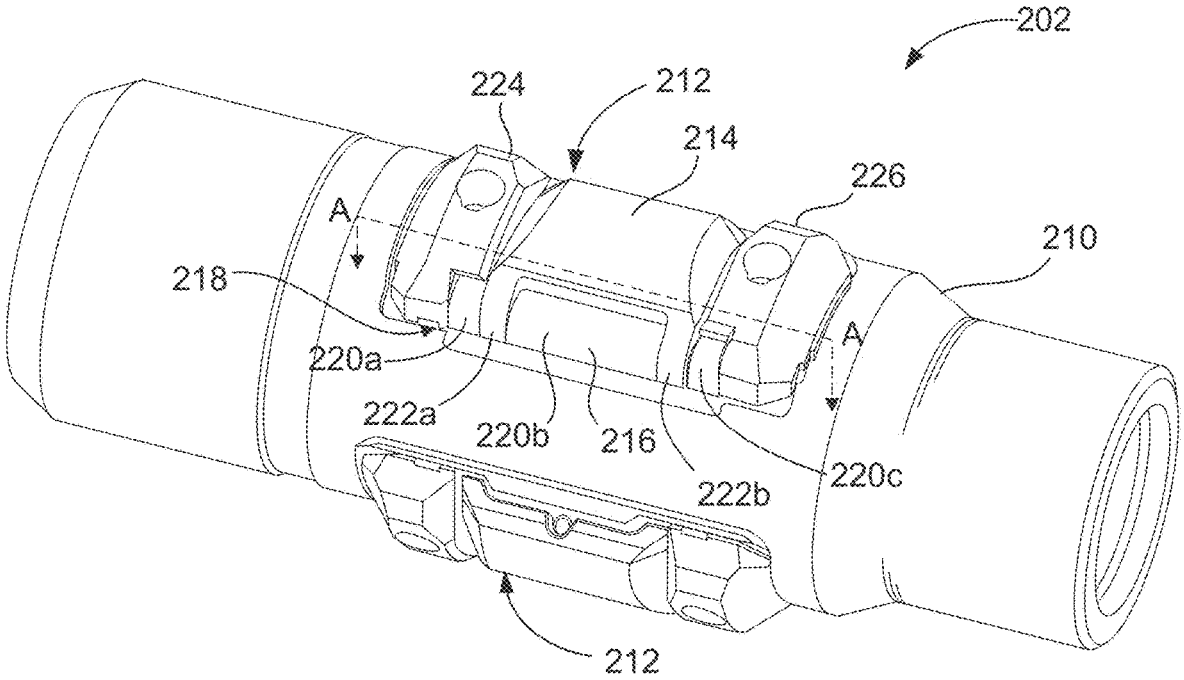
FIG. 2 is an enlarged perspective view of an example steering head comprising steering pad apparatuses according to some embodiments.

FIG. 2 is an enlarged perspective view of an example steering head 202 according to some embodiments. The steering head 102 of the bottom hole assembly 100 shown in FIG. 1 is similar to the steering head 202 of FIG. 2, for example. The steering head 202 includes the steering collar 210 and three steering pad apparatuses 212 spaced about the circumference of the collar 210 (although only two steering pad apparatuses 212 are visible in FIG. 2). Each steering pad apparatus 212 includes a respective pad housing 216 mounted to the collar 210, and a respective steering pad 214 mounted to the housing 216 by a hinge connection 218. The pad housing 216 functions as a base for the steering pad 214. The hinge connection 218 allows the steering pad 214 to rotate with respect to the pad housing 216. The steering pad 214 can, thus, rotate outward from the housing to an extended position and rotate inward to a retracted position (against the housing 216). The steering head 202 may typically also include an actuating mechanism (not shown) that acts against the steering pad 214 to actuate the extending and retracting. The actuating mechanism may, for example include a piston or other element (not shown) that extends outward through the housing 216 and contacts the steering pad 214.

The hinge connection 218 is formed by interleaved housing lugs 220*a* to 220*c*, pad lugs 222*a* and 222*b* and hinge pin 225 (shown in FIG. 6) that couple the lugs (220*a* to 220*c*, 222*a* and 222*b*). In this example, each housing 216 includes three housing lugs 220*a*, 220*b* and 220*c*, while each steering pad 214 includes two pad lugs 222*a* and 222*b*. The housing lugs 220*a* to 220*c* are spaced apart and axially aligned. The housing lugs 220*a* to 220*c* each define a respective hole 221*a*, 221*b* or 221*c* (shown in FIG. 4) axially therethrough. The steering pad lugs 222*a* and 222*b* are also spaced apart and axially aligned. The pad lugs 222*a* and 222*b* each define a respective hole 223*a* or 223*b* (shown in FIG. 3) axially therethrough. The pad lugs 222*a* and 222*b* are each positioned between two adjacent housing lugs 220*a*/220*b* or 220*b*/220*c*. The term "hinge pin" herein may refer to any elongate coupling member, such as a dowel, that at least partially extends through two or more lugs of a hinge to couple the lugs.

Embodiments are not limited to the particular hinge connection 218 shown in FIG. 2. The number, size, shape and/or placement of housing lugs and steering pad lugs may vary in other embodiments. For example, the second (middle) housing lug 220*b* in FIG. 2 may be replaced by two separate lugs, each coupled to a different pad lug. As another example, one or more holes for receiving hinge pins may only extend part way through the respective one or more lugs. As yet another example, the steering pad in another embodiment could comprise a single lug that is attached to a housing lug on one or both sides. Alternatively, the pad housing could comprise a single lug that is connected to a pad lug on one or both sides. Other variations are also possible.

Embodiments are also not limited to the pad housing 216 as the base for the steering pad 214. The base may be any structure to which the steering pad 214 is rotatably coupled. In some embodiments the base may be a portion of the collar 210 that comprises base lugs extending from the collar to be coupled to the steering pad.

In this embodiment, the steering pad apparatus 212 further includes an optional uphole lateral pad 224 positioned adjacent to and uphole of the steering pad 214. The steering pad apparatus 212 further includes an optional downhole lateral pad 226 positioned adjacent to and positioned downhole of the steering pad 214. The uphole lateral pad 224 and the downhole lateral pad 226 are fixedly mounted to the pad housing 216.

The steering pad 214 can rotate about the hinge connection 218 between retracted and extended positions. The movement may be used to cause the steering pad 214 to bear against the borehole surface in order to steer the steering head 202. This rotational movement of the steering pad may be actuated by the actuation mechanism (e.g. piston) that is not shown in FIG. 2. The steering pad 214 is shown in the retracted position in FIG. 2. In the retracted position, the steering pad 214 lays against the pad housing 216. During drilling operations, the steering pad 214 may, for example, extend and retract at up to 200 to 400 Rotations Per Minute (RPM).

Figure 5:
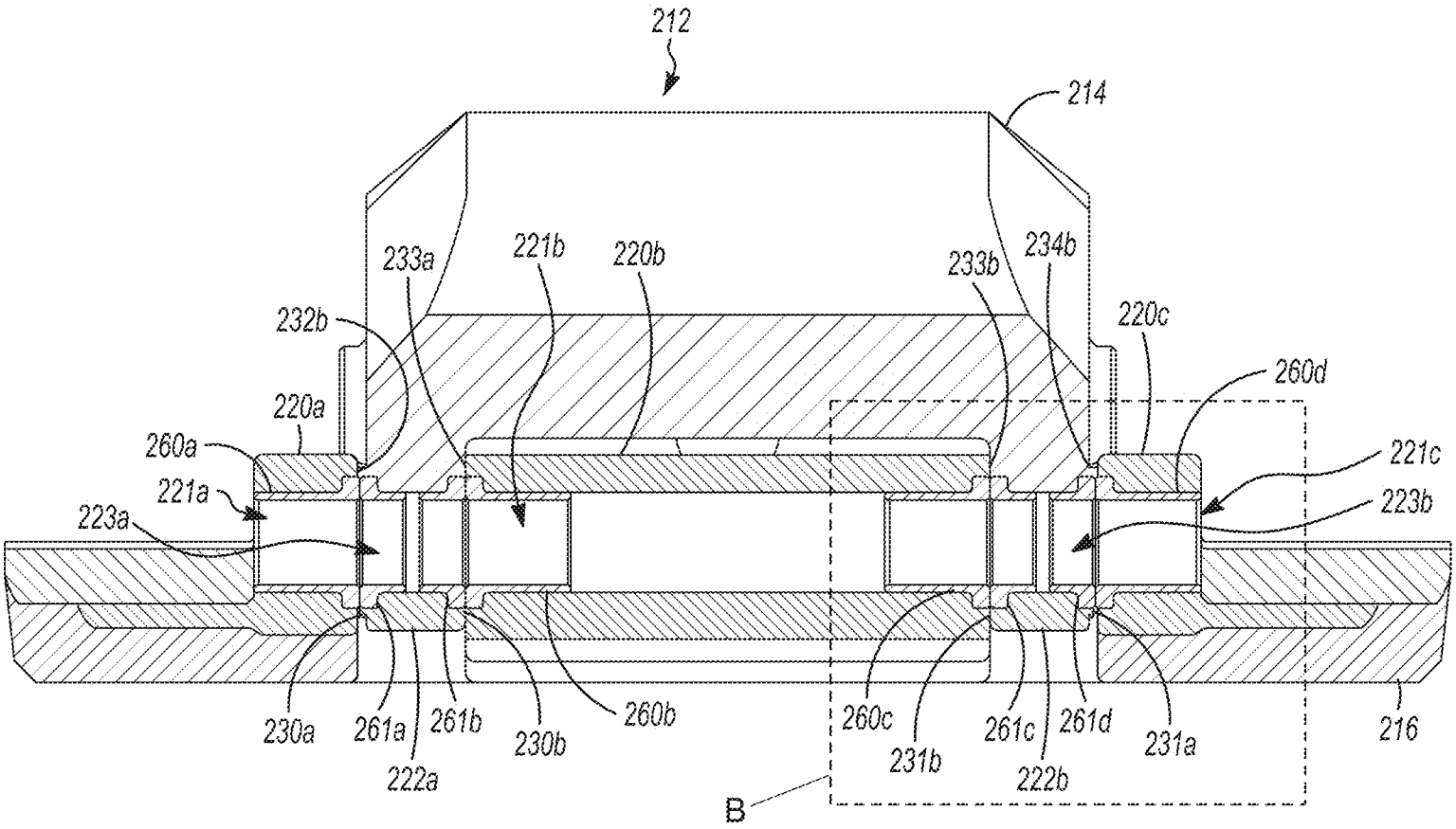
FIG. 5 is a cross sectional view of one of the steering pad apparatuses of FIG. 2, taken along the line A-A in FIG. 2.

The steering pad apparatus 212 of FIG. 2 further comprises bushings (260*a* to 260*d* and 261*a* to 261*d*) that are not visible in FIG. 2. The bushings are shown in FIG. 5 and are received in the housing lugs 220*a* to 220*c* and pad lugs 222*a* and 222*b*. The bushings 260*a* to 260*d* and 261*a* to 261*d* may prevent or reduce wear of the steering pad 214 due to the extending and retracting rotation of the steering pad 214 as explained in more detail below.

Figure 3:
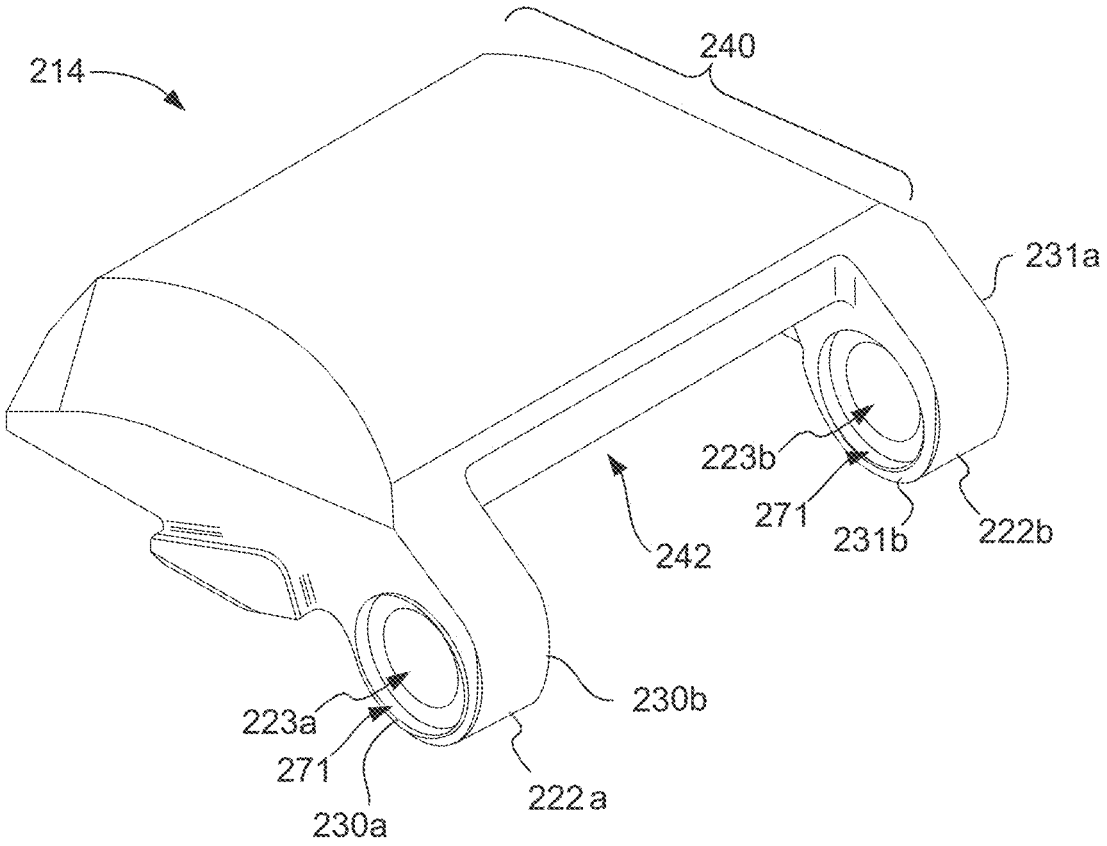
FIG. 3 is a perspective view of a steering pad according to some embodiments.

FIG. 3 is a perspective view of the example steering pad 214 of FIG. 2. As shown, the steering pad 214 includes a pad body 240 and the first and second pad lugs 222*a* and 222*b*. The first and second pad lugs 222*a* and 222*b* are spaced apart and extend from an end 242 of the pad body 240. Each of the pad lugs 222*a* and 222*b* defines a respective axial hole 223*a* or 223*b* therethrough. More specifically, the first pad lug 222*a* has opposite first and second sides 230*a* and 230*b* and defines hole 223*a* from the first side 230*a* to the second side 230*b*. Similarly, the second pad lug 222*b* has opposite first and second sides 231*a* and 231*b* and defines hole 223*b* from the first side 231*a* to the second side 231*b*. The pad lugs 222*a* and 222*b* optionally comprises grooves 271 about the peripheries of their holes 223*a* or 223*b* for seating the bushings received therein, as discussed in more detail below.

Figure 4:
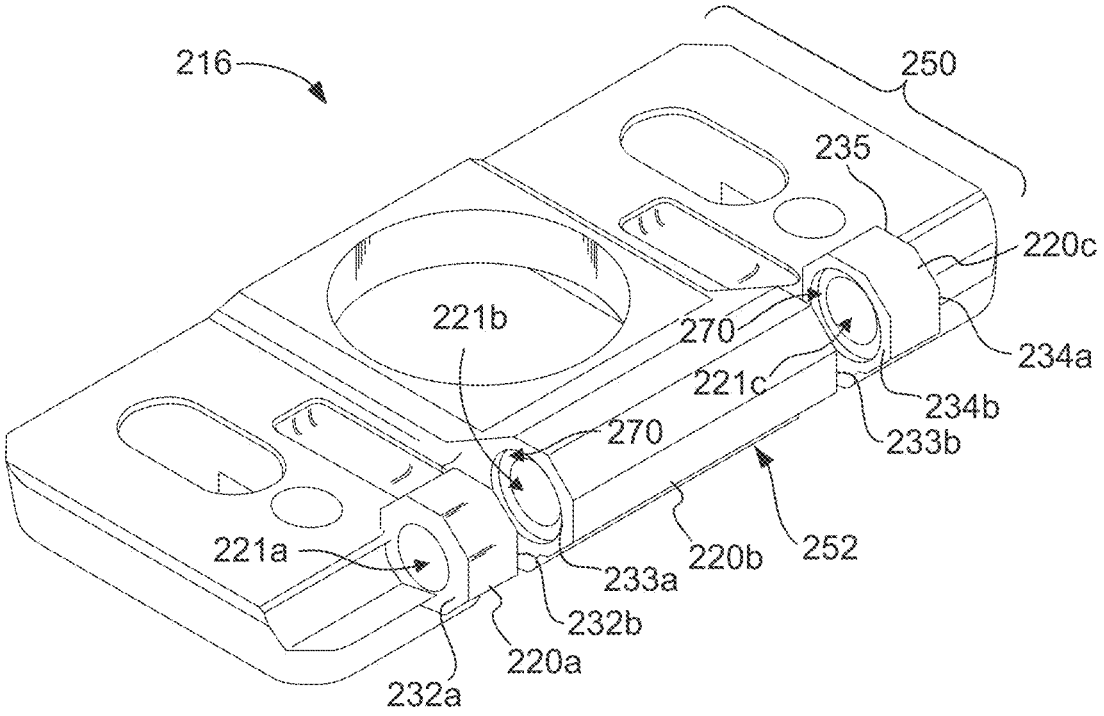
FIG. 4 is a perspective view of a pad housing according to some embodiments.

FIG. 4 is a perspective view of an example pad housing 216 that may be used in a steering pad apparatus (such as the steering pad apparatus 112 in FIG. 1).

As shown, the pad housing 216 includes a housing body 250 and the housing lugs 220*a* to 220*c*, which extend from an end 252 of the housing body 250. Each of the housing lugs 220*a* to 220*d* defines a respective axial hole 223*a* or 223*b* therein. More specifically: a first housing lug 220*a* has opposite first and second sides 232*a* and 232*b* and defines hole 221*a* from the first side 232*a* to the second side 232*b*; a second housing lug 220*b* has opposite first and second sides 233*a* and 233*b* and a hole 223*c* extending from the first side 233*a* to the second side 233*b*; and finally the third housing lug 220*c* has opposite first and second sides 234*a* and 234*b* and defines hole 221*c* from the first side 234*a* to the opposite second side 234*b*. Embodiments are not limited to a pad housing as the base for the steering pad. For example, the base may be any structure to which the steering pad is rotatably coupled. In some embodiments the base may be a portion of the collar including base lugs. Each of the housing lugs 220*a* to 220*c* optionally comprises a respective groove 270 about the periphery of its respective hole (221*a*, 221*b*, or 221*c*) as discussed in more detail below.

Figure 6:
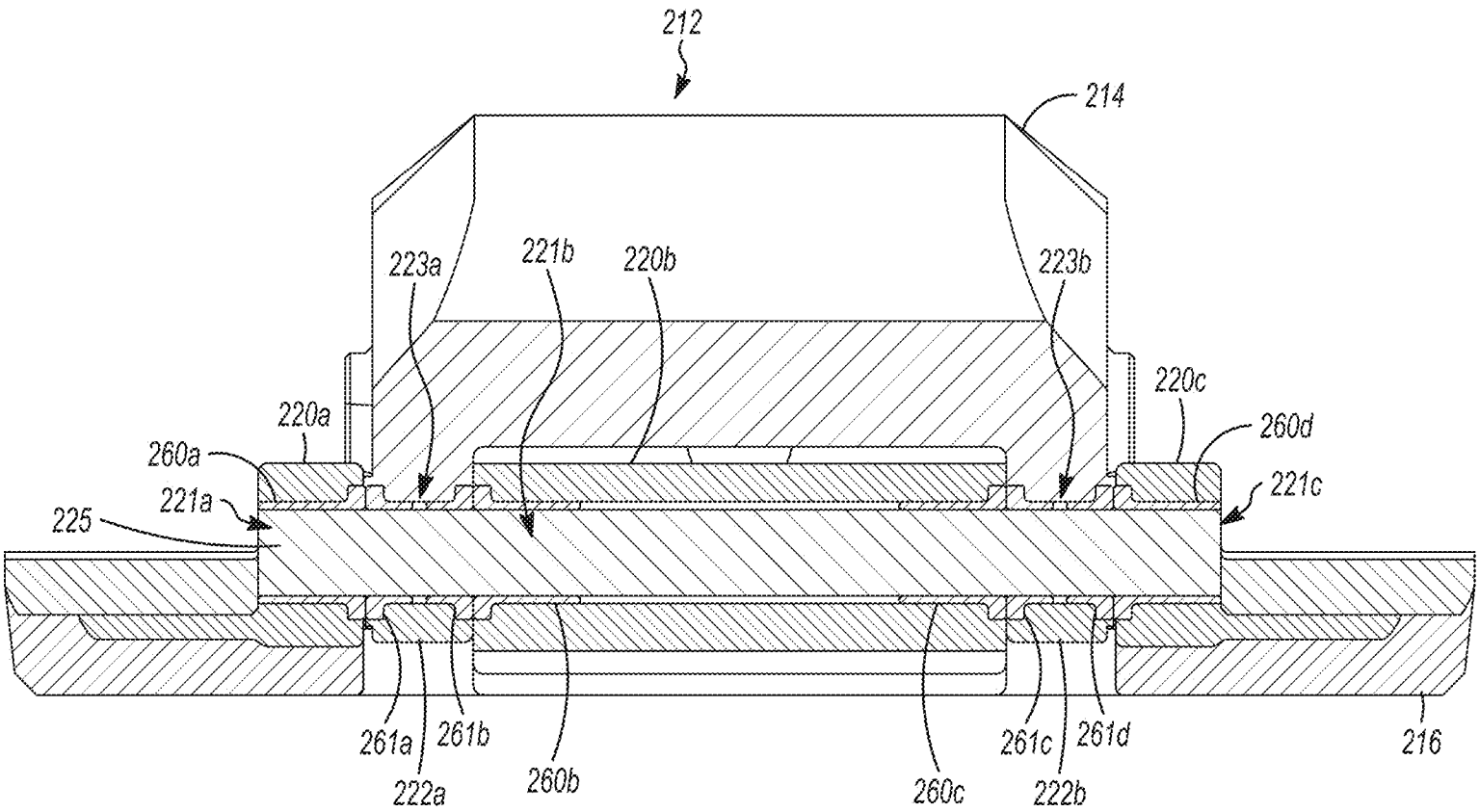
FIG. 6 is the cross sectional view of the steering pad apparatus of FIG. 5, but also showing hinge pins.

FIG. 5 is a cross sectional view of the steering pad apparatus 212 of FIG. 2, taken along the line A-A in FIG. 2. The uphole lateral pad 224 and the downhole lateral pad 226 are both removed in FIG. 5. The hinge pin 225 coupling the steering pad 214 to the housing 216 is also not shown in FIG. 5, but the pin 225 is shown in FIG. 6.

The housing lugs 220*a* to 220*c* are interleaved with the pad lugs 222*a* and 222*b*. The holes 221*a* to 221*c* of the housing lugs 220*a* to 220*c* are aligned with the holes 223*a* and 223*b* of the pad lugs 222*a* and 222*b* to receive the hinge pin 225 (shown in FIG. 6).

The first pad lug 222*a* is positioned between first and second housing lugs 220*a* and 220*b*. The first side 230*a* of the first pad lug 222*a* is adjacent to the second side 232*b* of the first housing lug 220*a*, and the second side 230*b* of the first pad lug 222*a* is adjacent to the first side 233*a* of the second housing lug 220*b*.

Similarly, the second pad lug 222*b* is positioned between second and third housing lugs 220*b* and 220*c*. The first side 231*a* of the second pad lug 222*b* is adjacent to the second side 234*b* of the third housing lug 220*c*, and the second side 231*b* of the second pad lug 222*b* is adjacent to the second side 233*b* of the second housing lug 220*b*.

For each adjacent pad lug (222*a* or 222*b*) and housing lug (220*a*, 220*b* or 220*c*), a pair of bushings is provided, which are received into the holes of the lugs, at the adjacent sides of the lugs. Specifically, a first pad bushing 261*a* and a first housing bushing 260*a* are received in adjacent sides of the first pad lug 222*a* and the first housing lug 220*a* respectively. The first housing bushing 260*a* is received in the hole 221*a* of the first housing lug 220*a* through the first side 232*a*, which is adjacent to the first pad lug 222*a*. The first pad bushing 261*a* is received in the hole 223*a* of the first pad lug 222*a* at its first side 230*a*, which is adjacent to the first housing lug 220*a*.

Similarly, a second pad bushing 261*b* and a second housing bushing 260*b* are received in adjacent sides of the first pad lug 222*a* and the second housing lug 220*b* respectively. The second housing bushing 260*b* is received in the hole 221*b* of the second housing lug 220*b* at the first side 233*a*, which is adjacent to the first pad lug 222*a*. The second pad bushing 261*b* is received in the hole 223*a* of the first pad lug 222*a* at the second side 230*b* of the first pad lug 222*a*, which is adjacent to the second housing lug 220*b*.

A third pad bushing 261*c* and a third housing bushing 260*c* are similarly received in adjacent sides of the second pad lug 222*b* and the second housing lug 220*b* respectively.

Finally, a fourth pad bushing 261*d* and a fourth housing bushing 260*d* are similarly received in adjacent sides of the second pad lug 222*b* and the third housing lug 220*c* respectively.

The bushings 260*a* to 260*d* and 261*a* to 261*d* are flange bushings in this embodiment, as explained in more detail below. However, embodiments are not limited to flange bushings in particular.

The pairs of bushings (260*a* and 261*a*, 260*b* and 261*b*, 260*c* and 261*c*, and 260*d* and 261*d*) are positioned to maintain a slight separation between the pad lugs 222*a* and 222*b* and the adjacent housing lugs 220*a* to 220*c*. More particularly, the first housing bushing 260*a* is proud of the second side 232*b* of the first housing lug 220*a*, and first pad bushing 261*a* is proud of the first side 230*a* of the first pad lug 222*a* respectively. The remaining pairs of bushings (261*b*, 260*c* and 261*c*, and 260*d* and 261*d*) are similarly proud of the corresponding sides of the lugs.

Thus, the bushings 260*a* to 260*d* and 261*a* to 261*d* may collectively prevent or reduce rubbing contact of the pad lugs 222*a* and 222*b* and housing lugs 220*a* to 220*c*, and wear of the steering pad 214 may thereby be diminished. As one or more of the bushings 260*a* to 260*d* and 261*a* to 261*d* become worn, they may be removed and replaced.

Not all embodiments include a pair of bushings for each adjacent housing lug and pad lug. For example, in some embodiments, for each adjacent housing lug and pad lug, only one bushing may be received in either the housing lug or the pad lug. The single bushing may still maintain a separation of the housing lug and the pad lug. Thus, as one example, bushings could be installed in only one of the steering pad and the housing (or other base for the steering pad).

FIG. 6 is the same cross sectional view of the steering pad apparatus 212 of FIG. 5, but also showing the hinge pin 225. The pin 225 is received through all of the lugs (220*a* to 220*c*, 222*a* and 222*b*) and bushings (260*a* to 260*d* and 261*a* to 261*d*) to couple the steering pad 214 to the housing 216. In other embodiments, two or more hinge pins may be used. For example, one hinge pin may be received in the first pad lug 222*a* and the two adjacent housing lugs 220*a* and 220*b* (through the first and second pairs of bushings 260*a*/261*a* and 260*b*/261*b*). Another hinge pin may be received in the second pad lug 222*b* and the two adjacent housing lugs 220*b* and 220*c* (through the third and fourth pairs of bushings 260*c*/261*c* and 260*d*/261*d*).

The inner diameter of each of the bushings (260*a* to 260*d* and 261*a* to 261*d*) is approximately equal to or nominally more than the outer diameter of the hinge pin 225, such that the pin 225 may be received through the bushings (260*a* to 260*d* and 261*a* to 261*d*) and allow the rotation of the steering pad 214 about the pin 225.

The outer diameter of each of the bushings (260*a* to 260*d* and 261*a* to 261*d*) may also be approximately equal to, or slightly less than, the inner diameter of the holes (221*a* to 221*c*, 223*a* and 223*b*) of the lugs (220*a* to 220*c*, 222*a* and 222*b*). Alternatively, the outer diameter of the bushings (260*a* to 260*d* and 261*a* to 261*d*) may be nominally more that the inner diameter of the holes (221*a* to 221*c*, 223*a* and 223*b*) such that the bushings may be press-fit into the holes and held in place by friction. Alternatively, in some embodiments, the outer surface of one or more bushings and the inner surface of the corresponding lug holes may be threaded, such that the one or more bushings are screwed into the lugs and axially secured by the threads. As yet another example, bushings may be held in the corresponding holes by an adhesive. Embodiments are not limited to any particular manner of securing bushings in corresponding lugs.

Figure 7:
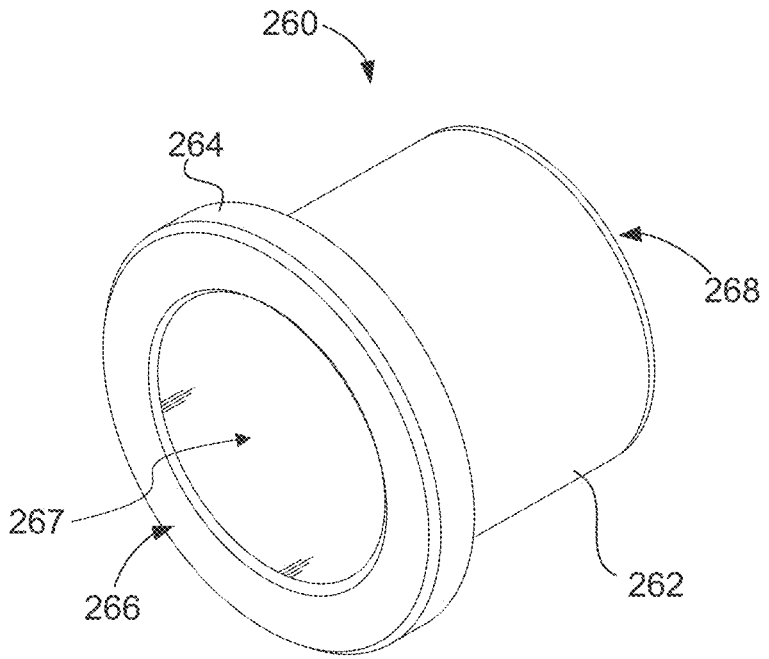
FIG. 7 is a perspective view of a flange bushing according to some embodiments.
Figure 8:
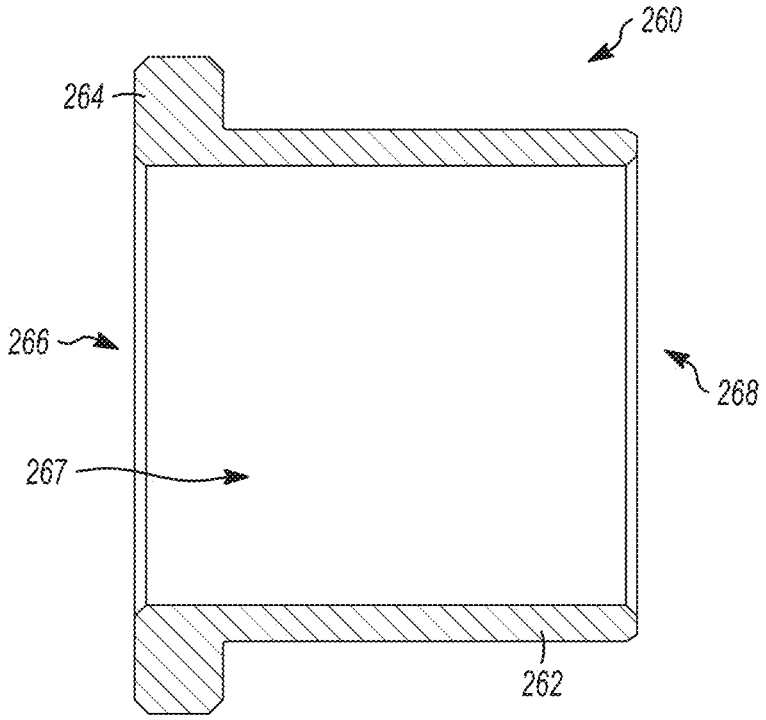
FIG. 8 is a side cross-sectional view of the flange bushing of FIG. 7.

FIGS. 7 and 8 are perspective and side cross-sectional views, respectively, of a flange bushing 260 according to some embodiments. Each of the flange bushings 260*a* to 260*d* in FIGS. 5 and 6 (received in the housing lugs 220*a* to 220*c*) are of the form shown in FIGS. 7 and 8. As shown, the flange bushing 260 is shaped similar to a top hat, comprising a tubular cylindrical portion 262 and a flange portion 264. The tubular cylindrical portion 262 has first and second ends 266 and 268 with a hole 267 extending from the first end 266 to the second end 268. The flange portion 264 extends about the periphery of the first end 266. The cylindrical portion 262 has a first outer diameter and the flange portion 264 has a second, greater outer diameter. The tubular cylindrical portion 262 acts as a radial bearing separating the hinge pin 225 and the corresponding lug, while the flange portion 264 acts as a thrust bearing maintaining a separation between adjacent lugs.

The flange bushing 260 (including the tubular cylindrical portion 262 and flange portion 264) may be a unitary structure. For example, the entire flange bushing 260 may be made by a moulding process or machined out of a single block of material. Alternatively, the tubular cylindrical portion 262 and the flange portion 264 may be formed separately and then attached together. The tubular cylindrical portion 262 and the flange portion 264 may be made from different materials. Embodiments are not limited to any particular method of making, or composition of the flange bushing 260.

In other embodiments, the bushings may not be flange-type bushings. For example, if the bearing may comprise only a tubular cylindrical portion, where the tubular cylindrical portion protrudes from the side of the corresponding lug to act as a thrust bearing (in addition to a radial bearing). The thickness, outer diameter, composition and/or other characteristics of the tubular cylindrical portion may be chosen to be suitable for this purpose. For example, the outer diameter of the tubular cylindrical portion may be chosen to match the outer diameter of the flange of the example bushing in FIGS. 7 and 8.

The flange bushings 261*a* to 261*d* (shown in FIGS. 5 and 6), which are received in the pad lugs 222*a* and 222*b*, are shorter than the bushings 260*a* to 260*d*. The shorter length accommodates the width of the pad lugs 222*a* and 222*b*. Otherwise, the flange bushings 261*a* to 261*d* received in the pad lugs 222*a* and 222*b* in this embodiment have a structure that matches the flange bushings 260*a* to 260*d* received in the housing lugs 220*a* to 220*c*.

Figure 9:
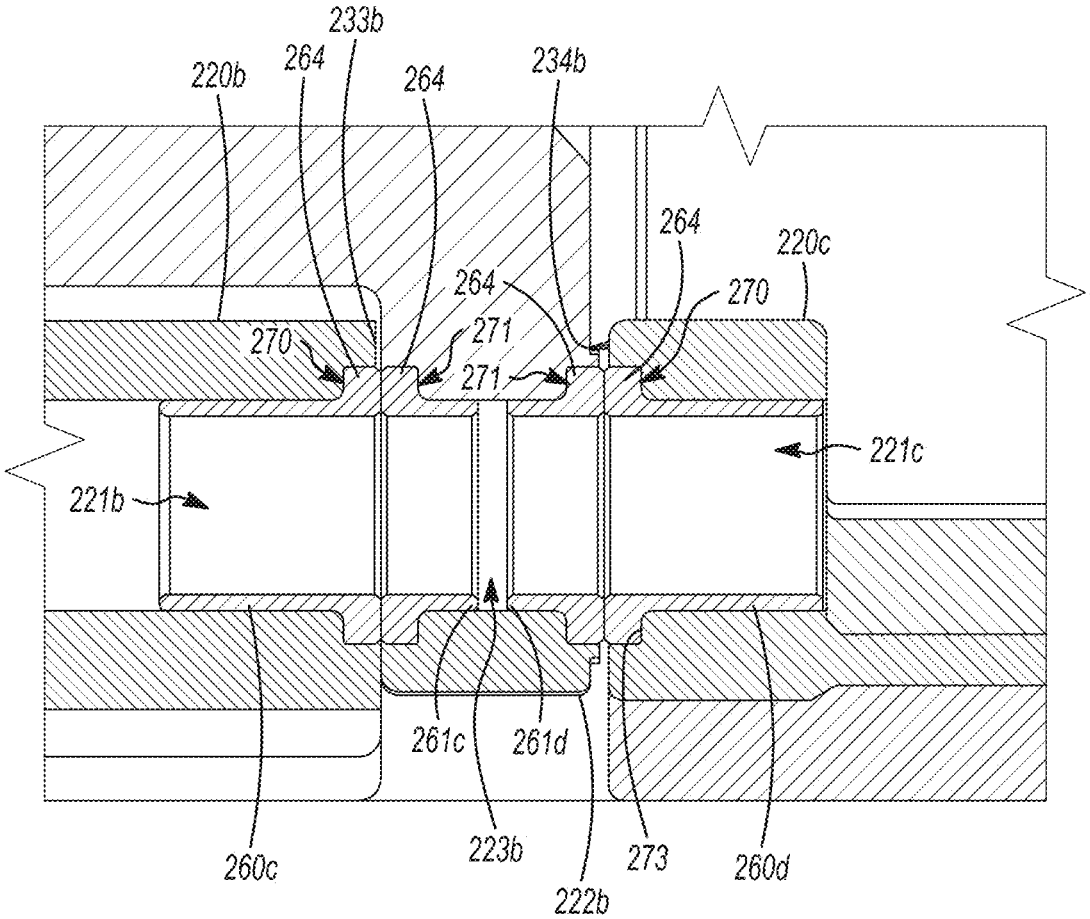
FIG. 9 is an enlarged view of the portion of the steering pad apparatus within the rectangle "B" in FIG. 5.

FIG. 9 is an enlarged view of the portion of FIG. 5 within the rectangle marked "B". As shown, the second sides 233*b* and 234*b* of the housing lugs 220*b* and 220*c* each define a groove 270 about the periphery of the corresponding hole 221*b* and 221*c* that receives the corresponding flange bushing (260*c*/260*d*). The grooves 270 are shaped to substantially receive the flange portions 264 of the flange bushings 260*c* and 260*d*. In other words, the grooves 270 have an inner diameter that is approximately equal to or greater than the outer diameter of the flange 264. The grooves 270 also each have a seating surface 273 (at least partially transverse to the axial direction of the hole through the corresponding lug) that acts as a stop or seat for the flange portion 264. The flange portions 264 are seated in the corresponding grooves 270 with each flange 264 abutting the seating surface 273 of the corresponding groove 270. Though not visible in FIG. 9, similar grooves 270 are defined in the remaining sides 232*a*, 232*b* and 233*a* (see FIG. 5) of the first and second housing lugs 220*a* and 220*b*.

The depth of each groove 270 is slightly less than the axial thickness of the flange portion 262 of the corresponding bushing, so that the bushings 260*a* to 260*d* are proud of (i.e. slightly protrude from) the sides 232*a*, 232*b*, 233*a*, 233*b*, 234*a* and 234*b* of the housing lugs 220*a*, 220*b* and 220*c*.

As also shown in FIG. 9, the hole 223*b* of the second pad lug 222*b* defines similar grooves 271 for receiving the flange portions 264 of the corresponding flange bushings 261*c* and 261*d*. In other words, the flange portions 264 of the flange bushings 261*c* and 261*d* are seated in the corresponding grooves 271. The flange bushings 261*c* and 261*d* are similarly proud of the sides 231*a* and 231*b* of the second pad lug 222*b*. Though not visible in FIG. 9, similar grooves 271 are formed in the sides 231*a* and 231*b* of the first pad lug 222*a*.

Embodiments are not limited to grooves for seating the flange portions as described above. For example, the flange portion may simply abut the side of the lug with the tubular portion extending into the lug. Embodiments are also not limited to a flange bushing configuration. For example, the bushing may simply be a tubular, without a flange.

In this embodiment, the grooves 270 and 271 are rabbet-type, right-angled grooves that are shaped complementary to the generally rectangular profile of the flange portions 264 of the bushings (260*a* to 260*d* and 261*a* to 261*d*). However, embodiments are not limited to this configuration and other flange portion shapes and groove shapes may be utilized in other embodiments.

Compared to the application of HVOF coatings on the lugs, the bushings described herein may be easier and less expensive to manufacture, install and repair. Replacing the bushings may also be easier and less expensive than replacing or repairing the steering pads or pad housings as required when HVOF coatings are worn. For example, the bushings may simply be replaced in the field without needing to send the worn bushings to a remote location or third party to repair. Furthermore, the bushings described herein may be used with a wider range of materials for the steering pad and pad housing lugs, in comparison to HVOF coatings which may limit the material of the lugs to tungsten carbide only.

The bushings may function as a wear surface or layer between the pad housings and the corresponding steering pads. The bushings may comprise various materials suitable for this purpose, including, but not limited to: carbide, such as impact or fracture resistant carbide; or steel, such as tool steel, or low alloy steel (e.g. 4330V), possibly with Laser Hardening to the surface of the flange portion. The surface of the flange may be wholly or partially coated with HVOF. In some embodiments, the surface of the flange is wholly or partially coated with one or more Physical Vapor Deposition (PVD) coatings to increase hardness and/or to reduce friction. Embodiments are not limited to carbide and steel, and the flange bushing could be made of any wear resistant material and/or coating, including materials not specifically mentioned in this disclosure. Furthermore, future materials yet to be produced could possibly be suitable.

Figure 10:
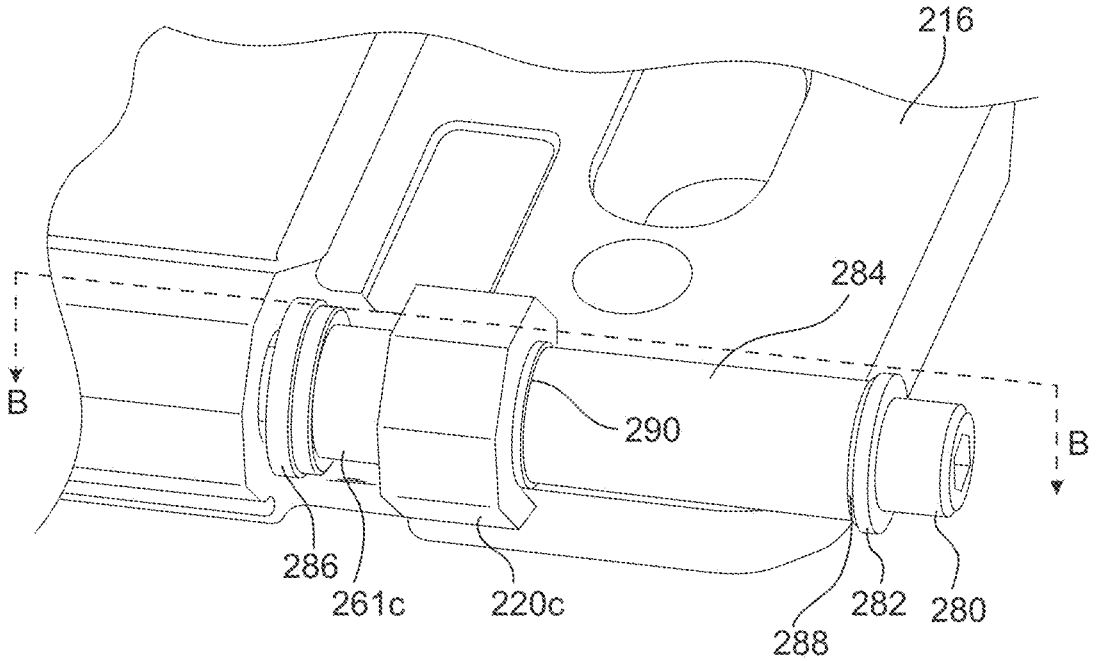
FIG. 10 is a perspective partial view of the pad housing of FIG. 4 and an example installation tool for installing the one or more bushings.
Figure 11:
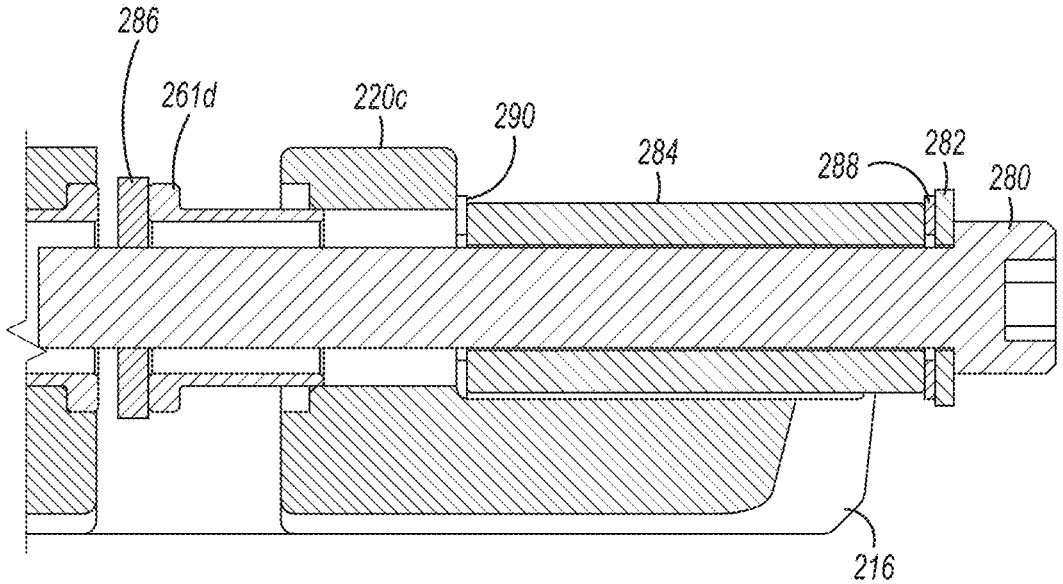
FIG. 11 is a cross-sectional view of the pad housing and installation tool taken along the line B-B in FIG. 10.

FIG. 10 is an enlarged partial perspective view of the pad housing 216 of FIG. 4. FIG. 11 is a cross sectional view of the pad housing 216 taken along the line B-B in FIG. 10. FIGS. 10 and 11 illustrate an example of how the bushings may be inserted into the housing lugs. More specifically, FIGS. 10 and 11 show the bushing 261*d* partially inserted into the third housing lug 220*c*. FIGS. 10 and 11 also show an example installation tool 279 that may be used to install the bushings (261*a* to 261*d* and 260*a* to 260*d*). However, embodiments are not limited to any particular tools or methods for installing bushings. In FIGS. 10 and 11, the bushing 261*d* is shown being inserted into the third housing lug 220*c*. The remaining bushings (260*a* to 260*d* and 261*a* to 261*c*) may be similarly installed using the example installation tool 279.

The installation tool 279 include a threaded screw 280, a load bearing extension 284, a threaded thrust flange washer 286, and first, second and third thrust flange washers 282, 288 and 290. The threaded screw 280 may be rotated 280 while keeping the threaded thrust flange washer 286 non-rotating. This rotation of the threaded screw 280 (relative to the threaded thrust flange washer 286) results in axial motion of the threaded thrust flange washer 286. Thus, the threaded thrust flange washer 286 may force the bushing into an interference fit with the corresponding hole of the lug. The load bearing extension 284 provides an extension to make a load bearing contact with the housing 216. The first, second and third thrust flange washers 282, 288 and 290 may reduce friction and prevent material galling.

In some embodiments, a steering system may comprise a collar and a plurality of steering pad apparatuses mounted on the collar. The collar may be a steering collar of a steering head, such as the steering head 102 or 202 shown in FIGS. 1 and 2. As another example, the collar may be a drilling collar and the steering pad apparatuses may be mounted on the drilling collar.

Figure 12:
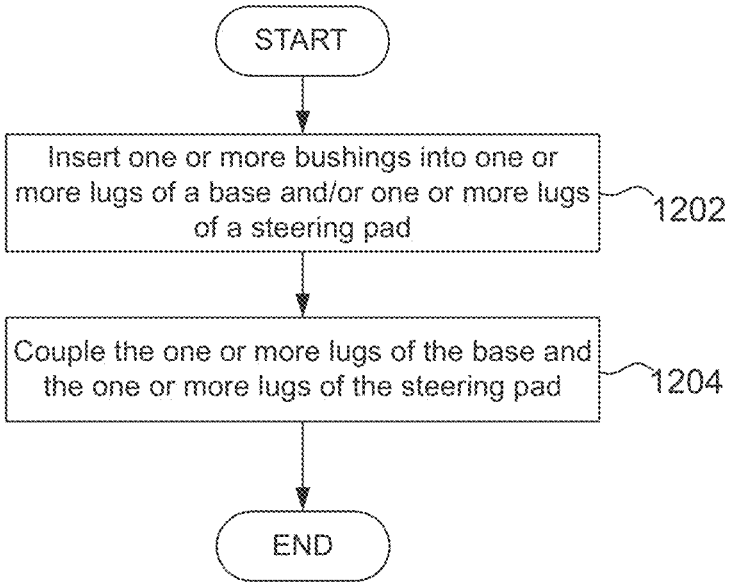
FIG. 12 is a flowchart of a method for a rotary steerable system according to some embodiments.

FIG. 12 is a flowchart of a method for a rotary steerable system according to some embodiments. The rotary steerable system comprises a pad housing and steering pad, similar to other embodiments described herein. The pad housing and steering pad each comprise a respective one or more lugs.

At block 1202, one or more bushings are inserted into at least one of: the one or more lugs of the pad housing; and the one or more lugs of the steering pad. The bushings may protrude from the corresponding lugs into which they are inserted, thereby maintaining a separation between adjacent lugs. In some embodiments, the bushings are flange bushings. The flange bushings may, for example, be in the form shown in FIGS. 7 and 8.

At block 1204, the lugs of the steering pad and the lugs of the pad housing are coupled to form a hinge connection. Coupling the lugs may comprise inserting one or more hinge pins (or other coupling members) into the lugs and bushings.

The method may further comprise removing and/or replacing one or more of the bushings. For example, if one or more bushings become worn or otherwise in need of replacement or repair, the one or more bushings may be removed from the steering pad apparatus and may be replaced by one or more new bushings. Alternatively, once repaired, the same one or more bushings may be re-installed in the steering pad apparatus. The repair may comprise refabricating, resurfacing, replacing and/or re-building at least a portion of the bushing. For example, repairing a bushing may comprise removing a damaged flange portion and attaching a new flange portion. The repair may also comprise removing one or more coatings and/or reapplying one or more coatings (e.g. HVOF or PVD coatings).

The method may further comprise providing the steering pad, the pad housing, and/or the bushings. The term "providing" may refer to buying, manufacturing, importing, or otherwise obtaining the relevant component(s).

In some embodiments, the steering pad (e.g. the steering pad 214 in FIG. 3) may be provided separate from the base. The steering pad may or may not be provided together with one or more bushings as described herein.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

It is to be understood that a combination of more than one of the approaches methods or apparatuses described herein may be implemented. Embodiments are not limited to any particular one or more of the approaches, methods or apparatuses disclosed herein. One skilled in the art will appreciate that variations or alterations of the embodiments described herein may be made in various implementations without departing from the scope of the claims.

Additional Disclosures

The following are non-limiting, specific embodiments of the rotating cutter apparatus described herein:

Embodiment A: A steering pad apparatus for a rotary steerable system, the steering pad apparatus comprising: a base comprising one or more base lugs, each of the base lugs defining a respective axial hole therein; a steering pad hingedly coupled to the base, the steering pad comprising one or more pad lugs, each said pad lug defining a respective axial hole therein, wherein the one or more pad lugs are coupled to the one or more base lugs such that each of the one or more pad lugs is adjacent to at least one of the one or more base lugs; and for each adjacent base lug and pad lug, a respective one or more bushings received in at least one of: the hole of the pad lug; and the hole of the base lug.

Embodiment B: The steering pad apparatus of Embodiment A, further comprising at least one coupling member received through the one or more bushings and the holes of the one or more base lugs and the one or more pad lugs.

Embodiment C: The steering pad apparatus of Embodiment A or B, wherein, for each said adjacent base lug and pad lug, the respective one or more bushings comprise first and second bushings.

Embodiment D: The steering pad apparatus of Embodiment C, wherein, for each said adjacent base lug and pad lug, the respective first bushing is received in the hole of the pad lug at a side of the pad lug adjacent to the base lug; and the respective second bushing is received in the hole of the base lug at a side of the base lug adjacent to the pad lug.

Embodiment E: The steering pad apparatus of any one of Embodiments A to D, wherein, for each said adjacent base lug and pad lug, the respective one or more bushings maintain a separation between the pad lug and the base lug.

Embodiment F: The steering pad apparatus of any one of Embodiments A to E, wherein, for each said adjacent base lug and pad lug, each of the one or more bushings protrudes from a corresponding one of: a side of the pad lug adjacent to the base lug; and a side of the base lug adjacent to the pad lug.

Embodiment G: The steering pad apparatus of any one of Embodiments A to F, wherein each said bushing comprises: a respective radial bearing portion and a respective thrust bearing portion.

Embodiment H: The steering pad apparatus of any one of Embodiments A to G, wherein the one or more bushings comprise one or more flange bushings.

Embodiment I: The steering pad apparatus of Embodiment H, wherein each flange bushing comprises: a tubular cylindrical portion having first and second ends; and a respective flange portion about a periphery of the first end of the tubular cylindrical portion.

Embodiment J: The steering pad apparatus of Embodiment I, for each said bushing, the corresponding lug comprises a respective groove about a periphery of the hole of the lug at a side of the lug through which the bushing is received, the groove being shaped to substantially receive the flange portion of the bushing.

Embodiment K: The steering pad apparatus of Embodiment J, wherein the flange portion is proud of the side of the lug.

Embodiment L: The steering pad apparatus of Embodiment I or J, wherein, for each said bushing, the respective flange portion and the respective tubular cylindrical portion are a unitary structure.

Embodiment M: The steering pad apparatus of any one of Embodiments A to L, wherein each of the one or more bushings is removable and replaceable.

Embodiment N: The steering pad apparatus of any one of Embodiments A to M, wherein the one or more base lugs comprise a plurality of base lugs, and each of the one or more pad lugs is positioned between, and adjacent to, two of the plurality of base lugs.

Embodiment O: The steering pad apparatus of any one of Embodiments A to O, wherein the base comprises a pad housing.

Embodiment P: A rotary steerable system for a downhole tool comprising: a tool collar; and one or more steering pad apparatuses mounted on the collar, each of the one or more steering apparatuses comprising: a respective base comprising one or more base lugs, each of the base lugs defining a respective axial hole therein; a respective steering pad hingedly coupled to the base, the steering pad comprising one or more pad lugs, each said pad lug defining a respective axial hole therein, wherein the one or more pad lugs are coupled to the one or more base lugs such that each of the one or more pad lugs is adjacent to at least one of the one or more base lugs; and for each adjacent base lug and pad lug, a respective one or more bushings received in at least one of: the hole of the pad lug; and the hole base lug.

Embodiment Q: The rotary steerable system of Embodiment P, wherein, for each said adjacent base lug and pad lug, the respective one or more bushings maintain a separation between the pad lug and the base lug.

Embodiment R: The rotary steerable system of Embodiment P or Q, wherein, for each said adjacent base lug and pad lug, the respective one or more bushings comprise first and second bushings.

Embodiment S: A method fora steering pad apparatus comprising a steering pad and a base, the method comprising: inserting one or more bushings into at least one of: one or more lugs of the base; and one or more lugs of the steering pad; and coupling the lugs of the steering pad to the lugs of the base to form a hinge connection between the base and the steering pad.

Embodiment T: The method of Embodiment S, wherein coupling the lugs of the steering pad to the lugs of the base comprises coupling the lugs of the steering pad to the lugs of the base with one or more hinge pins, the one or more hinge pins being received in the one or more bushings.

The invention claimed is:

1. A steering pad apparatus for a rotary steerable system, the steering pad apparatus comprising:

a base comprising one or more base lugs, each of the one or more base lugs defining a respective axial hole therein;

a steering pad hingedly coupled to the base, the steering pad comprising one or more pad lugs, each said pad lug defining a respective axial hole therein, wherein the one or more pad lugs are coupled to the one or more base lugs such that each of the one or more pad lugs is adjacent to at least one of the one or more base lugs; and for each adjacent base lug and pad lug, a respective one or more bushings received in at least one of: the hole of the pad lug; and the hole of the base lug;

wherein each of the one or more said bushings comprises: a respective radial bearing portion and a respective thrust bearing portion.

2. The steering pad apparatus of claim 1, further comprising at least one coupling member received through the one or more bushings and the holes of the one or more base lugs and the one or more pad lugs.

3. The steering pad apparatus of claim 1, wherein, for each said adjacent base lug and pad lug, the respective one or more bushings comprise first and second bushings.

4. The steering pad apparatus of claim 3, wherein, for each said adjacent base lug and pad lug, the respective first bushing is received in the hole of the pad lug at a side of the pad lug adjacent to the base lug; and the respective second bushing is received in the hole of the base lug at a side of the base lug adjacent to the pad lug.

5. The steering pad apparatus of claim 1, wherein, for each said adjacent base lug and pad lug, the respective one or more bushings maintain a separation between the pad lug and the base lug.

6. The steering pad apparatus of claim 1, wherein, for each said adjacent base lug and pad lug, each of the one or more bushings protrudes from a corresponding one of: a side of the pad lug adjacent to the base lug; and a side of the base lug adjacent to the pad lug.

7. The steering pad apparatus of claim 1, wherein the one or more bushings comprise one or more flange bushings.

8. The steering pad apparatus of claim 7, wherein each of the one or more flange bushings comprises: a tubular cylindrical portion having first and second ends; and a respective flange portion about a periphery of the first end of the tubular cylindrical portion.

9. The steering pad apparatus of claim 8, for each of the one or more said bushings, the corresponding lug comprises a respective groove about a periphery of the hole of the lug at a side of the lug through which the bushing is received, the groove being shaped to substantially receive the flange portion of the bushing.

10. The steering pad apparatus of claim 9, wherein the flange portion is proud of the side of the lug.

11. The steering pad apparatus of claim 8, wherein, for each of the one or more said bushings, the respective flange portion and the respective tubular cylindrical portion are a unitary structure.

12. The steering pad apparatus of claim 1, wherein each of the one or more bushings is removable and replaceable.

13. The steering pad apparatus of claim 1, wherein the one or more base lugs comprise a plurality of base lugs, and each of the one or more pad lugs is positioned between, and adjacent to, two of the plurality of base lugs.

14. The steering pad apparatus of claim 1, wherein the base comprises a pad housing.

15. A rotary steerable system for a downhole tool comprising:

a tool collar; and one or more steering pad apparatuses mounted on the tool collar, each of the one or more steering apparatuses comprising:

a respective base comprising one or more base lugs, each of the base lugs defining a respective axial hole therein;

a respective steering pad hingedly coupled to the base, the steering pad comprising one or more pad lugs, each said pad lug defining a respective axial hole therein, wherein the one or more pad lugs are coupled to the one or more base lugs such that each of the one or more pad lugs is adjacent to at least one of the one or more base lugs; and for each adjacent base lug and pad lug, a respective one or more bushings received in at least one of: the hole of the pad lug; and the hole of the base lug;

wherein each of the one or more said bushings comprises: a respective radial bearing portion and a respective thrust bearing portion.

16. The rotary steerable system of claim 15, wherein, for each said adjacent base lug and pad lug, the respective one or more bushings maintain a separation between the pad lug and the base lug.

17. The rotary steerable system of claim 15, wherein, for each said adjacent base lug and pad lug, the respective one or more bushings comprise first and second bushings.

18. A method for a steering pad apparatus comprising a steering pad and a base, the method comprising:

inserting one or more bushings into at least one of:

one or more lugs of the base; and one or more lugs of the steering pad; and coupling the lugs of the steering pad to the lugs of the base to form a hinge connection between the base and the steering pad;

wherein each of the one or more said bushings comprises: a respective radial bearing portion and a respective thrust bearing portion.

19. The method of claim 18, wherein coupling the lugs of the steering pad to the lugs of the base comprises coupling the lugs of the steering pad to the lugs of the base with one or more hinge pins, the one or more hinge pins being received in the one or more bushings.

* * * * *